United States Patent [19]

Grim

[11] 4,355,474

[45] Oct. 26, 1982

[54] ROLLER SKATE SOLE

[76] Inventor: Gary Grim, 1391 Poplar, Clarkston, Wash. 99403

[21] Appl. No.: 224,059

[22] Filed: Jan. 12, 1981

[51] Int. Cl.[3] ..... A43B 5/00; A63C 3/00

[52] U.S. Cl. ..... 36/132; 280/825

[58] Field of Search ..... 36/132, 7.5; 280/809, 280/811, 289, 30, 816, 825

[56] References Cited

U.S. PATENT DOCUMENTS 3,861,697 1/1975 Dolce ..... 280/825

3,898,749 8/1975 Famolare ..... 36/132

*Primary Examiner*—Patrick D. Lawson

*Attorney, Agent, or Firm*—Wells, St. John & Roberts

[57] ABSTRACT

A flexible sole that can be attached by a skater to his roller skates to immobilize the wheels and provide a sole surface for relatively normal walking. The sole includes an elongated sheet with releasable mounting members at opposite ends. The mounting members may be attached to the skate in such a manner that the sheet is drawn tautly over the wheels. The wheels are engaged by an upper surface of the sheet while a bottom surface functions as a relatively stationary walking surface.

16 Claims, 3 Drawing Figures

ROLLER SKATE SOLE

BACKGROUND OF THE INVENTION

The present invention relates to an apparatus for immobilizing roller skates for walking purposes.

Roller skating has recently become nearly as popular as bicycling. In fact, some advocates use roller skates as a primary mode of transportation. Modern designs for roller skates allow their use in many areas which would have been impractical or impossible to skate over in the past.

Along with the increasing popularity of roller skating comes a real potential danger of liability suits and property damage that has caused many business proprietors to forbid roller skaters on their premises. Skaters must therefore remain out of such areas or remove their skates before entering them. Such regulations are unsatisfactory for both the skater and businessman. The skater is frustrated by the "no skaters" rule and the businessman by the loss of potential customers.

It thus becomes desirable for skaters to be provided with some form of device that mounts easily and quickly to the roller skates to immobilize the wheels and provide a walking surface, thereby allowing the skater to walk while wearing the skates. Such an apparatus would protect the skater, the proprietor's interest, and the roller skates themselves.

U.S. Pat. No. 3,898,749 to Famolare discloses a wear sole for mounting on roller skate wheels. The device is comprised of a pair of rubber members that encircle longitudinally spaced rollers on opposite sides of the skate. The device mounts solely to the wheels of the roller skates so longitudinal positioning of the wheels on the skates dictates the size between openings of the device. The device is therefore not universally adaptable to the many varieties and sizes of skates presently being used.

U.S. Pat. No. 3,861,697 to Samuel L. Dolce discloses a roller skate walker. This walker includes a relatively rigid plate having four upwardly open depressions, each for receiving a roller skate wheel. A strap extends from the device to fit over the vamp of the roller skate shoe. Although this device secures itself partially to the roller skate shoe, the depressions dictate acceptable roller skate size. Provisions are made for longitudinally spacing the indentations. There are no provisions made, however, to adapt the "walker" to skates having different lateral spacing between wheels.

The present invention provides roller skates with a universally adaptable sole that will fit virtually any modern form of roller skate and that can be easily folded and stored within a pocket, purse, etc. The present device securely immobilizes the roller skate wheels and provides a flat walking surface that will allow relatively normal walking by the skate either on smooth or rough surfaces. There are substantially no adjustments necessary either longitudinally or transversely to adapt the present sole to a particular pair of skates.

DETAILED DESCRIPTION OF A PREFERRED EMBODIMENT

Figure 1:
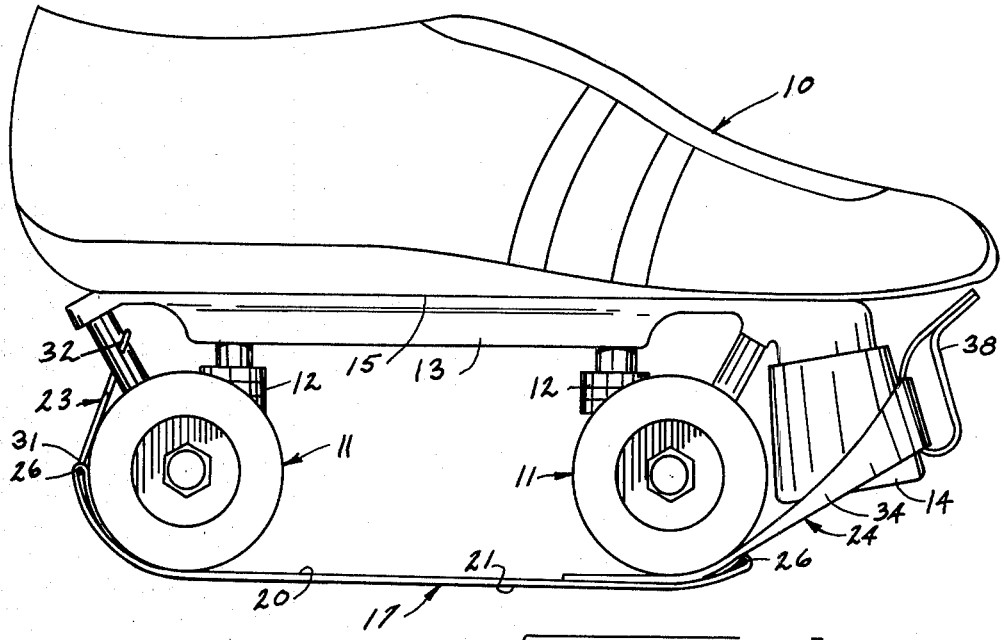
FIG. 1 is a side elevational view of a roller skate showing the present invention mounted thereon.

The present invention is intended for use in immobilizing the wheels of and providing a stationary walking surface for roller skates 10 (FIG. 1). The illustrated roller skate 10 is typical of many modern forms of roller skates, having two longitudinally spaced pairs of wheels 11. The wheels of each pair are spaced apart transversely. The wheels are mounted for rotation about substantially fixed axes by forward and rearward trucks 12. The trucks 12, in turn, are mounted to or are part of a rigid undercarriage 13 along the bottom 15 of the skate shoe. A stop pad 14 may project from one or both ends of the skates. The stop pad 14 as shown in the drawings is a typical configuration used on many modern skate designs. However, it is recognized that other forms of skates make use of rearward stop pads or include both front and back stop pads. The present invention will operate as well on any of these forms of roller skates.

The present sole is shown generally in the drawings at 17. The sole 17 is formed partially as an elongated sheet 18 of pliable, wear-resistant material. The sheet 18 includes a length between opposed transverse ends that is greater than the distance between the axes of wheels 11 for all normal skate sizes. The transverse width dimension of sheet 18 is greater than the transverse spacing of the wheels in each pair. The sheet can thus be placed with a first upwardly facing surface 20 engaging all four wheels 11 and with a parallel, second surface 21 exposed outwardly as a walking surface.

First and second mounting means 23 and 24 respectively are provided at opposed ends of the sheet 18 for releasably attaching sheet 18 to the rear (heel) and front (toe) ends of the skate. The mounting means 23, 24 holds the sheet tautly against all wheels along the first surface 20. This holds the wheels immobile and exposes the second surface 21 outwardly as a supporting walking surface.

Rigid struts 26 assist the mounting means 23 and 24 to maintain the sheet in position relative to the wheels and provide some transverse or lateral stability to the otherwise flexible sheet. The struts might be held in place at the ends of the sheet by rivets 27 that extend through flaps formed in the sheet material at the respective ends 19.

Figure 2:
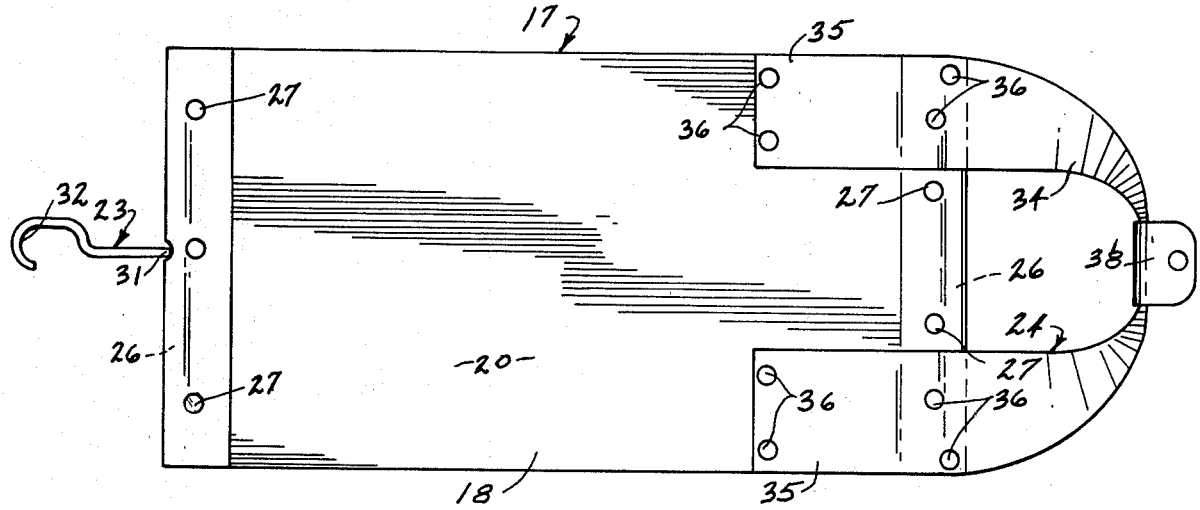
FIG. 2 is a plan view of the present flexible sole.
Figure 3:
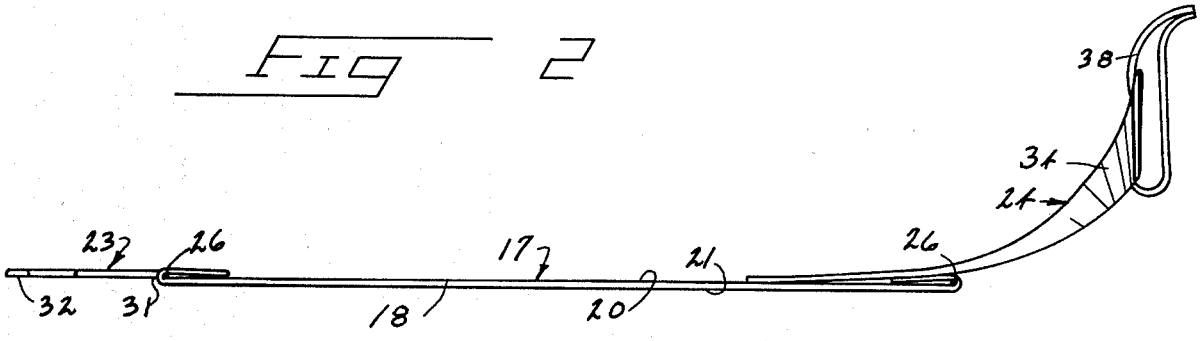
FIG. 3 is a side elevation view of the present sole.

The first mounting means 23 (shown in detail in FIGS. 1 and 2) may be comprised of a hook 30 having one end 31 attached to the sheet and a remaining hooked end 32 adapted to releasably engage the adjacent truck 12. Preferably, the hook is rigidly attached to the adjacent strut 26.

The second mounting means 24 might include an elongated strap 34 having opposed ends 35 fixed to sheet 18. The strap ends might be attached by rivets 36 as shown or by other conventional fasteners or adhesive. The strap between ends 35 forms a closed loop that is adapted to engage over the stop pad 14. A pull tab 38 is provided on the loop to present a gripping surface for the skater, aiding both attachment and removal of the sole.

It is preferred that the strap ends 35 overlap the first surface 20 of sheet 18 along opposed longitudinal sides thereof. The strap ends 35 will therefore engage one pair of the skate wheels as shown in FIG. 1 when the sole is mounted to a skate. The thickness of the sole is therefore increased at a point where excessive wear can occur.

The present sole may be mounted to a skate as shown in FIG. 1 simply by hooking the first mounting means 23 over the rearward truck 12. The skater can then grasp the pull tab 38 and pull the sheet forwardly and longitudinally to engage the wheel pairs along the first surface 20. The sheet is stretched tautly as the strap 34 is engaged over the stop pad 14.

Frictional engagement between the wheels 11 and sheet 18, plus the secure mounting of the sheet to the skate, immobilizes the wheels. The outside sheet surface 21 then becomes stationary relative to the skate and presents a downwardly facing walking surface.

It should be pointed out that the particular arrangement of wheel trucks and stop pads shown in FIG. 1 is currently popular but not in exclusive use. Other skates include different arrangements of the wheel spacing, wheel base (distance between the rotational axes of the wheels) and form and placement of the stop pad or pads. For this reason, the present sole is adapted for mounting to many such other forms of skates. For example, a skate having a rearward stop pad could be selectively covered by the present sole simply by reversing the ends, placing the loop over the rearward projecting stop pad and connecting the hook 30 over the truck at the front, toe end of the skate. On skates not having a stop pad, strap 34 can be designed to engage over the forward or toe end of the shoe. Other modifications may also be envisioned without departing from the scope of the present invention.

What I claim is:

1. A movable flexible sole for releasable attachment to a roller skate having longitudinally spaced front and rear pairs of wheels at the respective front and rear ends of the skate to cover the wheels and hold them immobile and to allow relatively normal walking by one wearing the roller skate, said sole comprising:

an elongated sheet of flexible material having opposed ends and first and second opposed outer surfaces extending between said ends;

said sheet having a transverse width dimension greater than transverse spacing between paired wheels of the roller skate;

first and second releasable mounting means at the respective sheet ends for selectively attaching the sheet to the front and rear ends of the skate with the sheet taut and the first sheet surface engaging all wheels to hold them immobile and with the second sheet surface exposed outwardly as a supportive walking surface.

2. The flexible sole as claimed by claim 1 for roller skates having a rigid longitudinal undercarriage mounting the wheel pairs, wherein the first releasable mounting means is adapted for attachment to the undercarriage adjacent one end of the skate.

3. The flexible sole as claimed by claim 2 for a roller skate having a stop pad projecting from the skate, and wherein the second releasable mounting means is adapted for attachment to the stop pad.

4. The flexible sole as claimed by claim 1 for a roller skate having a stop pad projecting from the skate at one end thereof, and wherein the second releasable mounting means is adapted for attachment to the stop pad.

5. The flexible sole as claimed by claim 1 further comprising:

rigid supportive struts extending across the transverse width of said sheet at the ends thereof; and wherein the one of said releasable mounting means is attached to one of said struts.

6. The flexible sole as claimed by claim 5 wherein the distance along the sheet between the struts is at least equal to the dimension along the skate between the axes of the front and rear wheel pairs.

7. The flexible sole as claimed by claim 1 for a roller skate having a rigid longitudinal undercarriage including wheel trucks adjacent opposed ends thereof mounting the wheel pairs, wherein the first releasable mounting means is comprised of a hook at one end of said sheet, adapted to be attached to one of the wheel trucks.

8. The flexible sole as claimed by claim 7 for a roller skate having a stop pad projecting from an end thereof opposite said one wheel truck, wherein the second releasable mounting means is comprised of a strap attached to the sheet at a remaining end thereof and is adapted to be engaged over said stop pad with the sheet drawn tautly over the front and rear pairs of wheels.

9. The flexible sole as claimed by claim 8 further comprising:

a pull tab mounted to the strap.

10. The flexible sole as claimed by claim 8 wherein the strap is comprised of flexible material and includes opposed ends attached to the sheet along the first outer surface thereof, at positions thereon for engaging a pair of said wheels when the sole is mounted to the roller skate.

11. The flexible sole as claimed by claim 10 further comprising:

rigid struts mounted at opposite ends of the sheet and extending across the width dimension thereof.

12. A flexible sole removably mountable to a roller skate for covering the wheels and holding them immobile, thereby allowing relatively normal walking by one wearing the roller skate, the roller skate having front and rear wheel trucks rotatably mounting front and rear pairs of transversely spaced wheels for rotation about longitudinally spaced axes at opposed ends of the roller skate and with a stop pad projecting from one end of said skate, wherein said sole is comprised of:

an elongated sheet having a length dimension between its ends that is greater than the distance between the wheel axes of the roller skate and a width dimension greater than the transverse spacing between the wheels of each pair;

first and second opposed outer surfaces extending between the ends of said sheet;

first mounting means on the sheet for releasably attaching one end of the sheet to one of the skate trucks spaced farthest from the stop pad; and second mounting means on the sheet for releasably attaching the remaining end of the sheet to the stop pad, with the first surface of the sheet tautly engaging the wheels of both pairs and the second surface exposed outwardly as a supportive walking surface.

13. The flexible sole as claimed by claim 12 further comprising:

rigid struts extending across the width of said sheet at the ends thereof; and wherein the one of said releasable mounting means is attached to one of said struts.

14. The flexible sole as claimed by claim 12 wherein the first mounting means is comprised of a hook attached at one end of the sheet and having a remaining end adapted to be hooked over the one skate truck.

15. The flexible sole as claimed by claim 12 wherein the second mounting means is comprised of an elongated strap having opposed ends fixed to the sheet to form a loop extending longitudinally from the remaining end of the sheet adapted to fit over the stop pad.

16. The flexible sole as claimed by claim 15 wherein the first mounting means is comprised of a hook attached at one end of the sheet and having a remaining hooked end adapted to be hooked over the one skate truck.

* * * * *